United States Patent [19]

Steiner

[11] Patent Number: 4,935,155

[45] Date of Patent: Jun. 19, 1990

[54] CLOTHES DRYING APPARATUS

[76] Inventor: Walter Steiner, Säntisstrasse 52, CH-8311 Brütten, Switzerland

[21] Appl. No.: 259,889

[22] Filed: Oct. 19, 1988

Related U.S. Application Data

[63] Continuation of Ser. No. 929,992, Nov. 12, 1986, abandoned.

[30] Foreign Application Priority Data

Nov. 16, 1985 [EP] European Pat. Off. ..... 85114578.9
Jan. 16, 1986 [CH] Switzerland ..... 163/86

[51] Int. Cl.[5] ..... A47B 47/00

[52] U.S. Cl. ..... 211/197; 211/119.15; 211/119.01

[58] Field of Search ..... 242/47.5, 47, 100, 100.2, 242/107, 107.1, 107.13; 211/197, 119.01, 196, 119.15, 1.3

[56] References Cited

U.S. PATENT DOCUMENTS 1,192,985 8/1916 Butler ..... 24/127 X
1,620,590 3/1927 Betts ..... 211/119.15 X
3,193,212 7/1965 Lotta ..... 242/100 X
4,553,715 11/1985 Roselli ..... 211/119.1 X

FOREIGN PATENT DOCUMENTS 390863 8/1965 Switzerland .
1112518 5/1968 United Kingdom ..... 211/196

*Primary Examiner*—Blair M. Johnson
*Attorney, Agent, or Firm*—Tarolli, Sundheim & Covell

[57] ABSTRACT

The invention provides a clothes drying apparatus with a central post member, a collar member axially displaceably mounted on the supporting post member and a plurality of support arms. A plurality of clothes line portions of a first clothes line extend between the support arms.

Operating means are provided to spread the support arms from a rest position into a extended position in which the clothes line portions extending between the support arms are in an essentially stretched condition. In order to provide the possibility to dry a few pieces of clothing only without the need of putting the entire apparatus into its operative position, a supply of a second clothes line may be pulled out from the apparatus and fixed at a distantly located anchoring member. Upon releasing the end of the second clothes line, it is automatically drawn back. During use it may be locked at the top of the clothes drying apparatus.

1 Claim, 4 Drawing Sheets

CLOTHES DRYING APPARATUS

This is a continuation of co-pending application Ser. No. 929,992 filed on Nov. 12, 1986 now abandoned.

BACKGROUND OF THE INVENTION

The present invention relates to a clothes drying apparatus which comprises a central, elongate supporting post member, a collar member surrounding the supporting post member and being axially displaceably mounted on the supporting post member. The apparatus further comprises a plurality of support arms, one end thereof being pivotally mounted on the collar member, and a first clothes line constituting a plurality of clothes line portions which extend between the support arms.

The central supporting post member is equipped with a head member mounted on the top of the supporting post member, and a plurality of strut members, one end thereof being pivotally connected to the head member and the other end thereof being pivotally connected to one of the support arms.

Operating means are provided to spread the support arms from a rest position in which the arms are in an essentially parallel position to the central supporting post member, into an extended or spread out position in which the clothes line portions extending between the support arms are in an essentially stretched condition, by displacing the collar member from a lower rest position towards said head member into an operative position.

PRIOR ART

A clothes drying apparatus of this or a similar kind is known e.g. from Swiss Patent No. 390'863, and further known from various different embodiments commercially available and in widespread use in households.

Even if these apparatus have proven very practical, reliable and space-saving, there is a major disadvantage: Anytime when pieces of clothes have to be dried the entire clothes drying apparatus has to be put into operation, i.e. the support arms have to spread out from their inoperative or rest position parallel to the central supporting post member in their spread out position in order to stretch the clothes line portions extending between the arms. However, sometimes, only a very few pieces have to be hung onto the clothes line and it may be cumbersome to put the apparatus into operation.

OBJECTS OF THE INVENTION

It is a primary object of the present invention to improve an clothes drying apparatus of the prior art as hereinbefore discussed in a completely different and hitherto unknown manner so that the aforementioned disadvantages no longer occur.

Particularly, it is an object of the invention to improve a clothes drying apparatus of the kind referred to in such a manner that it may be ensured, using the same apparatus, without the need of a cumbersome unspreading of the support arms in order to expose the clothes line, to dry a few pieces of clothes in a quick and efficient manner.

SUMMARY OF THE INVENTION

The invention provides a clothes drying apparatus which comprises a central, elongate supporting post member and a collar member surrounding the supporting post member which is axially displaceably mounted on the supporting post member. The apparatus further includes a plurality of support arms, one end thereof being pivotally mounted on the collar member, and a first clothes line comprising a plurality of clothes line portions extending between said support arms.

A head member is mounted on the top of the supporting post member, and a plurality of strut members are provided, one end thereof being pivotally connected to the head member and the other end thereof being pivotally connected to one of the support arms.

In order to put the apparatus into the usual, normal operative position, i.e. from a rest position, in which the arms are in an essentially parallel position with regard to the central supporting post member, into an extended position in which the clothes line portions extending between the support arms are in an essentially stretched condition, the collar member is displaced under the effect of operating means from a lower rest position towards the head member.

In order that the same apparatus may be also used for a few pieces of clothes without the need of unspreading the support arms, a second clothes line is provided, including clothes line supply means and clothes line retracting means, so that said second clothes line leaving the supporting post member in the region of its head member may be pulled out from the clothes line supply means against the influence of the clothes line retracting means and may be temporary and releasably connected to an anchoring member distantly located the said supporting post member, e.g. a wall, a tree or the like.

In a first embodiment, the central supporting post member is hollow and receives the supply of second clothes line in its interior. Preferably there is provided a locking means mounted in the region of the second clothes line outlet which includes a stretching or tensioning means adapted to stretch or tension the pulled out portion of the second clothes line which is releasably connected to the distantly located anchoring member. To facilitate the operation of the apparatus, the stretching means is self-locking.

In a second embodiment, the supply of said second clothes line is mounted on the outer surface of the supporting post member. In this embodiment as well, locking means mounted in the region of the second clothes line outlet may be provided, incorporating stretching means adapted to stretch said pulled out second clothes line portion which is releasably connected to the distantly located anchoring member.

In an even more preferred first embodiment, the supply of second clothes line is guided over at least two pulleys mounted remote from each other in the kind of a pulley block, at least one of said pulleys being freely hanging suspended and drawn away from the head portion of said supporting post member by means of a weight member or a spring member. Thereby, if the end of the pulled out second clothes lines is released, it will be drawn back into the interior of the central supporting post member.

In an even more prefered second embodiment, the supporting post member comprises a rotatable drum mounted on the top portion of the supporting post member, the axis of rotation of said drum member being coaxial to the axis of the supporting post member. The drum member receives the supply of said second clothes line, and for drawing back or retracting the released second clothes line portion, there is provided a spring means which is operatively connected to the drum. The spring biases the drum to a rotation which is contrary to the rotating direction of the drum when the second clothes line is supplied therefrom. Preferably, the drum is enclosed by a hood member coaxially arranged with reference to the supporting post member and having an outlet opening through which said second clothes line passes.

The hood member has not only the purpose of protecting the second clothes line supply from contamination when it is in its rest position.

Moreover, the hood, together with the drum, is received on a rotatable and axially displaceable shaft so that the drum and the hood member together may be displaced from a rest position where they cover the top end portion of said supporting post member into an operating position where they are taken off from the top end portion of said supporting post member. Thereby, the hood member, being in said rest position, overlaps and locks the end portions of the support arms of the clothes drying apparatus and prevents any unintentional spreading apart of said support arms, while the end portions of the support arms are released when the hood member is in its operative position.

BRIEF DESCRIPTION OF THE DRAWINGS

In the following, a number of embodiments of the apparatus according to the invention will be further described, with reference to the accompanying drawings, in which.

DESCRIPTION OF PREFERED EMBODIMENTS

The general design of such an umbrella-like or spider's web-type clothes drying apparatus is adequately known from constructions thereof available in numerous households, as well as from the aforementioned publications, removing the need to give further detailed explanations or to present additional drawings.

Figure 1:
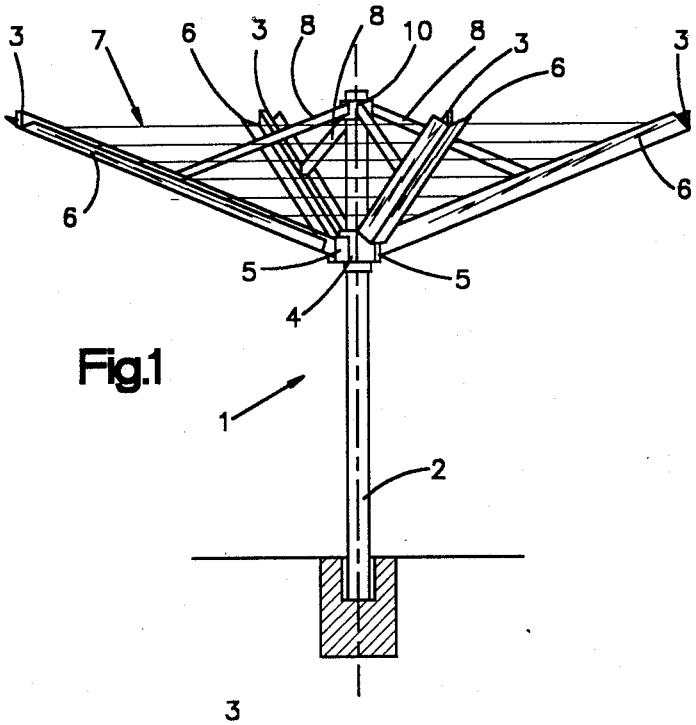
FIG. 1 shows a schematic overall side view of a known umbrella-like clothes line supporting apparatus in its operative position.
Figure 2:
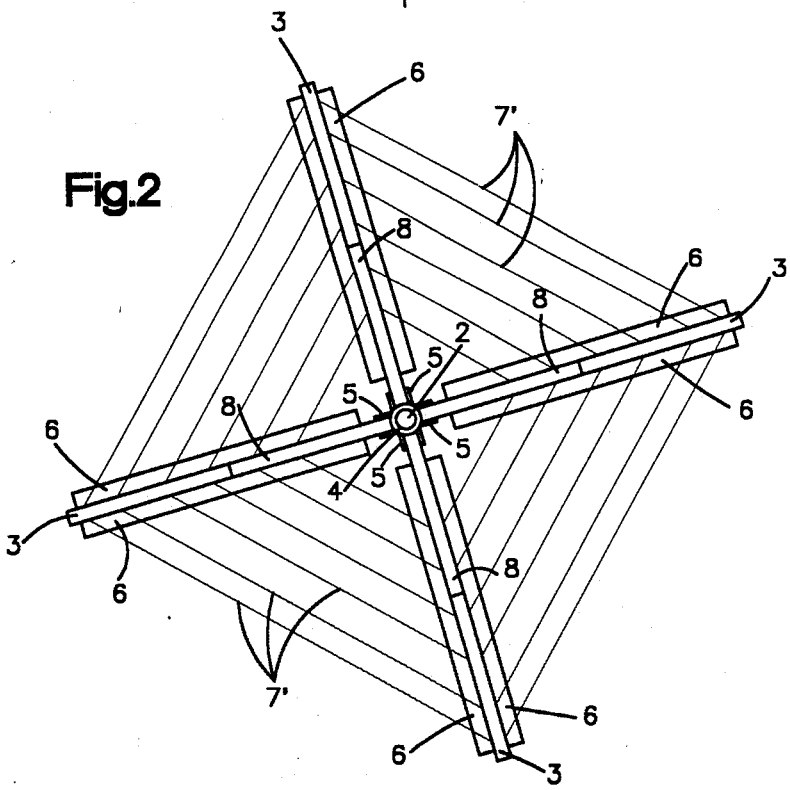
FIG. 2 shows a schematic top view of the apparatus of FIG. 1.

The clothes drying apparatus as shown in the attached drawing FIGS. 1 and 2 comprises a plurality, e.g. four support arms 3 which are arranged in equidistant relationship around a central, vertical supporting post 2. The support arms 3 together serve as a support for a clothes line 7 whose portions 7' extend between the individual support arms 3 when said arms 3 are in their spread out position (i.e. in the operative position of the clothes drying apparatus), as shown in FIGS. 1 and 2.

The central post 2 comprises a slidably mounted collar 4 surrounding the post 2 and having four radially protruding webs 5. The lower ends of the four support arms 5 are pivotally mounted on the webs 5. Struts 8 are provided, one strut 8 being associated to each one supporting arm 3, and one end thereof being pivotally mounted on the support arm 3 in a predetermined distance from the linkage 6. The other end thereof, i.e. the end remote from the support arm 3, is pivotally mounted on a head member 10 arranged on the top of the central post 2.

When the clothes drying apparatus 1 is not in use, the support arms 3 are pivoted against the central post 2 and consequently also the struts 8. The collar 4 is in its lowermost position and the previously stretched clothes line portions 7' hang loosely down between the support arms 3.

Figure 3:
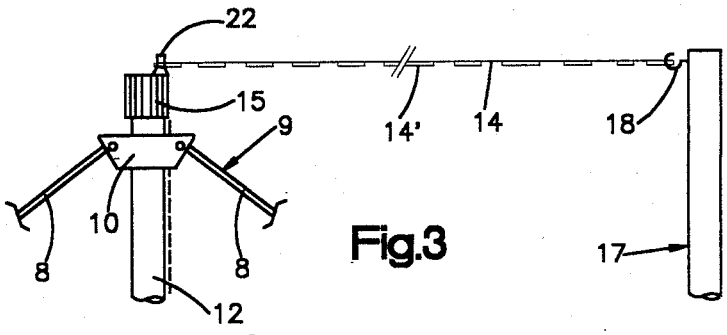
FIG. 3 shows a partial side view of a clothes drying apparatus according to the invention with a clothes line led to a second clothes post.

As can be seen in FIG. 3, the central supporting post of the invention generally consists of a post member 12, a clothes line supply 13 and a post head portion 15 also serving as a locking device for the additionally provided clothes line 14. In the embodiment shown in FIG. 3, the clothes line supply 13 is constituted by a spool member 16 rotatably mounted on an outer surface of the post member 12. The spool member 16 includes a roll which receives a sufficient supply of an additional clothes line 14. The latter one is drawn from the spool member 16 to the head portion 15 and therefrom to e.g. a further post 17 or to another fixing means, e.g. a (not shown) wall, where the loop-like end part of the additional clothes line 14 is attached to a hook 18. The design of the head portion 15 may correspond to that of the embodiment according to FIGS. 4 or 5 or to that of FIGS. 6 and 7, respectively.

In its simplest form, the post member 12 is constituted by a hollow tubular element which can be inserted in a receptacle provided in the ground. The post member 12, thereby, is the supporting element of an umbrella-like clothes drying apparatus as it is shown in FIGS. 1 and 2 and which is known per se in numerous embodiments (e.g. from Swiss Patent No. 390,863 and others). In FIG. 3, this is indicated by partially showing the struts 8 and the head portion 10.

Figure 4:
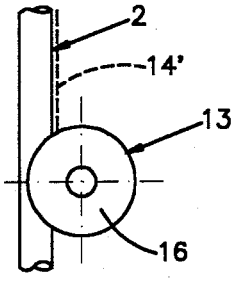
FIG. 4 shows a partially broken side view of a second embodiment of a clothes drying apparatus according to the invention.
Figure 4:
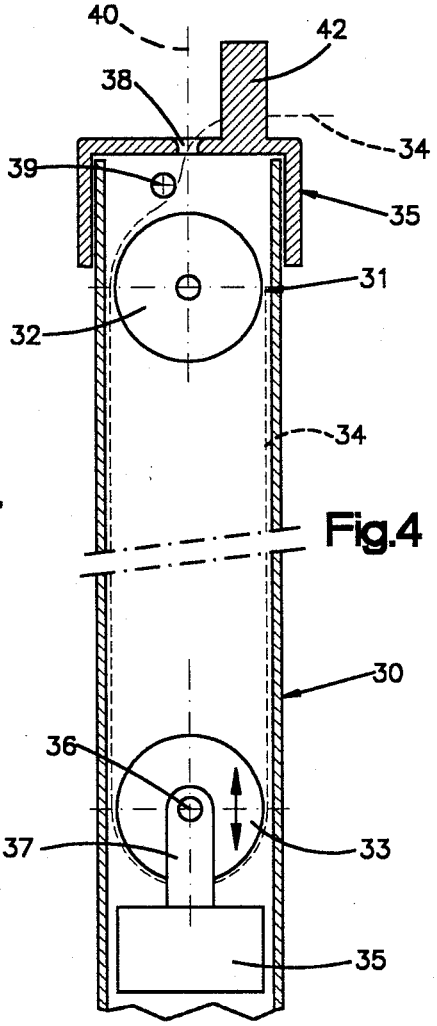
Figure 5:
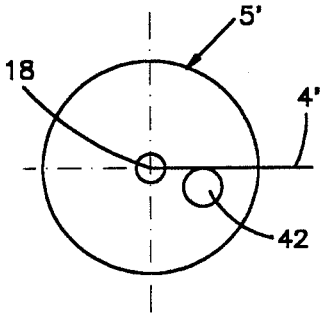
FIG. 5 shows a top view of the embodiment of FIG. 4.

In the embodiment according to FIGS. 4 and 5 the supply of additional clothes line 31 consists of a pulley-block like device comprising at least two rolls 32 and 33 over which passes to and fro the clothes line 34 indicated by the dashed lines. The upper roll 32 has, with reference to the post member 30, a fixed position and is mounted rotatably around a shaft 44, whilst the lower roll 33 is freely suspended on the clothes line 34 and is drawn downwards by means of a weight 35 or a (not shown) tension spring. The lower roll is rotatably mounted on a shaft 36 which is fixed to the supporting arm 37 of the weight 35. In the case of two pulleys or rolls 32 and 33 both are preferably provided with a number of adjacent circumferential guiding grooves, for winding the clothes line about the rolls 32 and 33 for storage. Another possibility is to provide a plurality of upper and lower pulleys or rolls 32 and 33, respectively, the clothes line being drawn between these two pluralities of pulleys or rolls in order to obtain a sufficient large supply of additional clothes line 34 within the interior of the post member 30.

From the clothes line supply 31 and 13, respectively, the clothes line 34 and 14, respectively, is drawn upwards to the head member 35 and 15, respectively, and is passed through a central opening 38 provided in the latter one and is drawn outwards. Said opening 38 is coaxially situated with reference to the longitudinal axis of the post member and coincides with the rotational axis of the rotatably mounted head member 35 which is put onto the upper end of the post member 30 in a cup-like manner. From said central opening 38, the clothes line 34 is led horizontally e.g. to a further post member 17 as shown in FIG. 3. Furthermore, a guide pin 39 may be provided within the post member 30 in front of the central outlet opening 38.

In order to stretch the clothes line 14 and 34, respectively, led from the post member 2 and 30, respectively, outwards to a locking point (e.g. a hook 18) and/or to lock the same to said post member, the head portion 15 and 35, respectively, is manually rotated about its axis 40 so that the clothes line 14 and 34, respectively, is wound onto the winding pin 22 and 42, respectively, eccentrically shaped onto or fixed to the head member 15 and 35, respectively. A subsequent unwinding of the clothes line 14 and 34, respectively, from the winding pin 22 and 42, respectively, under the influence of the tension acting on the clothes line is prevented by the eccentric arrangement of the winding pin 22 and 42, respectively, with respect to the rotation axis 40 and the position of the opening 38 of the head member 15 and 35, respectively. The natural elasticity of the clothes line 14 and 34, respectively, assists this self-locking action.

After releasing the clothes line 14 and 34, respectively, from e.g. the hook 18 of an adjacent post 17, the clothes line 14 and 34, respectively, is automatically wound back into the clothes line supply 13, e.g. through the tension of a not shown torsion spring, or is again drawn back into the hollow post member 32 through the tension of the weight 35.

In order to reliably prevent any slipping of the clothes line on the winding pin 22 and 42, respectively, under the load of the clothes hung thereon, said winding pins can have a profiled or roughened surface, or an angularly shaped cross section.

The grip of the head member 15 and 35, respectively, can also be increased by external profiling, as indicated in FIG. 3.

Figure 6:
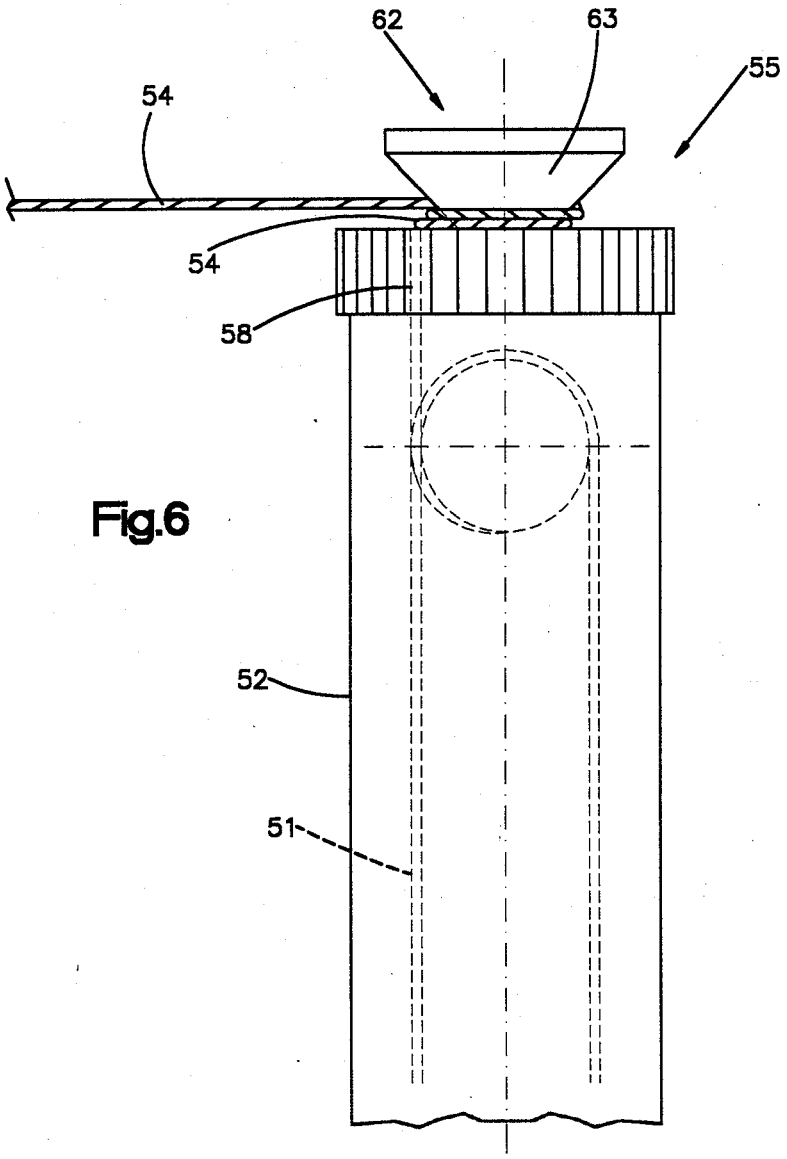
FIG. 6 shows a side view of the top portion of a third embodiment of the clothes drying apparatus according to the invention.

FIG. 6 shows another embodiment, particularly with respect to the design of the head member which here is designated with reference numeral 55. The design of the post member 52 and of the mechanism for providing the additional clothes line 51 and 54, respectively, can be the same as in the previously described embodiments. The same is true for the fact that the post member 52 is part of an umbrella-like clothes drying apparatus, e.g. as shown in FIGS. 1 and 2.

It is essential for the embodiment according to FIG. 6 that the head member 55 has an eccentrically positioned outlet opening 58 out of which the clothes line 54 passes from the interior of the post member 52, and that the head member 55 is provided with a centrally positioned mushroom-shaped extension 62 which extends upwards. Its conical portion 63 tapers towards the surface of the head member 55.

By rotating either the complete post member 52 or the head member 55, if it is rotatably mounted, the clothes line 54 is wound around the extension 62. Thereby the clothes line 54 is clamped in the lower region of the tapered portion 63 of the extension 62 and stretched, either by rotating the entire post member 52 or by rotating only the head member 55. Particularly if the head member 55 is rigidly mounted on the post member 52, the elasticity of the clothes line 54 results in a bending stress of the post member 52 which prevents the latter one from further rotational movement; once again, also in this case, a self-locking action is realized.

According to a further embodiment which is not explicitely shown in the drawings, but which has to be taken into consideration as well, the clothes line could be passed along the outside of the post member instead of being passed and received, respectively, within the interior thereof. This constructional possibility is of particular interest if the clothes line supply is stored on a reel located outside the post member, e.g. as indicated in FIG. 3. In such a case, in the region of the top end of the post member a guide member, e.g. a deviation pulley would be provided. The clothes line to be drawn off then runs from the reel to said guide pulley which is positioned adjacent to the aforementioned locking device, and is passed therefrom e.g. to an adjacent clothes post or to a hook anchored on an adjacent house wall, a tree etc. Locking of the clothes line can take place in the manner described and explained hereinbefore. Such alternative design as just explained is indicated by dashed lines of the clothes line 14' in FIG. 3.

Figure 7:
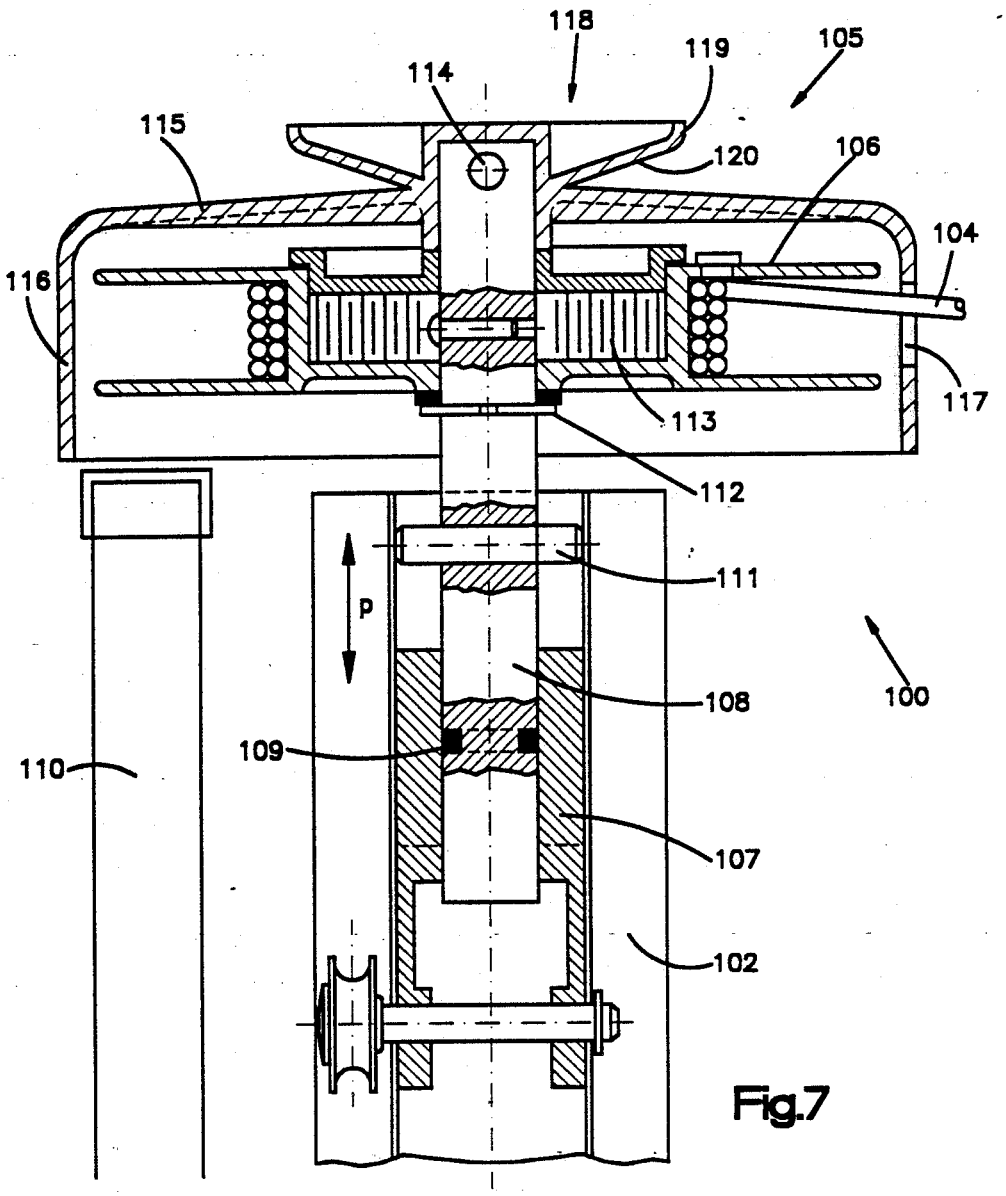
FIG. 7 shows a sectional view of the top portion of a fourth embodiment of a clothes drying apparatus according to the invention.

A further embodiment is shown in FIG. 7. As partially shown in the drawing, the clothes post 100 according to the invention consists of a post member 102, an additional clothes line supply 103 and a post head member 105 simultaneously serving as a locking device for the clothes line 104. The clothes line supply 103 is in the form of a reel or drum 106 mounted at the top of the post member 102 and onto which is wound an adequate length of a clothes line 104. The clothes line 104 may be drawn off the drum 106 and passes via the head member 105 to a second post or another locking means, e.g. a not shown wall where the loop-like end of the clothes line is fixed to a hook.

In its simplest form the post member is constituted by a hollow tubular element which can be inserted in a receptacle in the ground and which is the central supporting post of an umbrella-like clothes drying apparatus as shown in FIGS. 1 and 2.

Into the upper end of the post member 102 is inserted a pivot bearing bush 107 which receives a shaft 108 which is on the one hand rotatable and on the other hand longitudinally displaceable in the direction of arrow P. An O-ring 109 provided on the shaft 108 ensures a sealing of the interior of the post member 102 and provides that a certain frictional resistance opposes the rotary and sliding movement of the shaft 108 relative to the post member 102. A pin 111 which diametrally traverses the shaft 108 limits the sliding motion of the shaft 108 by abutting against the upper surface of the pivot bearing bush 107.

The upper free end of the shaft 108 receives the reel or drum 106. The downward positional fixing is realized by means of a disc-like collar 112 mounted on the shaft 108. The reel or drum 106 is rotatably mounted on the shaft 108, a torsion spring 113 being inserted between the reel or drum 106 and the shaft 108 which attempts to rotate the reel or drum 106 in a direction opposite to the unwinding direction of the clothes line 104. This means that when the clothes line 104 is slack, it will be automatically wound back onto the reel or drum 106 for forming the clothes line supply 103.

Above the reel or drum 106, the head member 105 is mounted on the shaft 108. A pin 114 is provided to prevent the head member 105 to rotate with reference to the shaft 108. The head member 105 has the shape of a hood 115, the cylinder jacket-like sidewall 116 thereof enclosing the reel or drum 106. The side wall 116 is provided with an opening 117 to enable the clothes line 104 to be drawn out. The top of the hood 115 is provided with a locking member 118. It comprises a centrally mounted, upwardly projecting, mushroom-shaped extension member 119 which is preferably shaped in one piece onto the hood 115. Its conically shaped portion 120 tapers towards the upper surface of the hood 115.

In the embodiment as shown in FIG. 7 of the drawing, it is essential for the head member 105 to have an eccentrically located outlet opening 117 through which the clothes line 104 passes from the interior of the head member 105, and that the head member 105 is provided with the centrally arranged, mushroom-shaped extension member 119 which extends upwardly. Its conically shaped portion 120 which tapers towards the head member 105 locks the clothes line 104 when it is wound around the extension member 118.

By rotating either the complete post member 102 or preferably only the rotary head member 105, the clothes line 104 is wound around the extension member 119; the clothes line will be clamped in the lower part of the conically shaped portion 120 of the extension 119 and thereby lockingly fixed. Due to the elasticity of the clothes line 104, a bending force is exerted to the post member 102 and thereby the post member 102 will be prevented from further rotational movement; in this manner, a self-locking effect is provided also in this embodiment.

As already mentioned, the shaft 108 is not only rotatable but also displaceable in the direction of its axis with regard to its height. Thereby, the reel or drum 106 as well as the hood 115 may be shifted from a rest position in which they cover the top side of the post member 102 into an extended operating position as shown in FIG. 7 of the drawings. Starting from the position as shown in FIG. 7, it is supposed that the support arms 110 of an umbrella-like clothes drier (only one support arm 110 being shown in the drawing) are in their collapsed position extending substantially parallel to the central post member 102. Now the hood 115 as well as the drum or reel 106 may be displaced into their rest position downwards so that the side wall 116 overlaps the ends of the support arms 110 and locks them in their collapsed position, thereby preventing an unintended folding out of the arms 110. It is of no importance whatsoever for the functioning of the additional clothes line supply, i.e. the clothes line 104 from the drum or reel 106, whether the hood 115 is in its upper operating position or in its lower rest position.

The clothes line supporting apparatus according to the invention gives the possibility to improve a known umbrella-like clothes drier by providing it with an additional clothes line supply which may be used e.g. for a small amount of clothes to be dried without the need to put the entire umbrella-like apparatus into operation, i.e. without spreading out the support arms for the clothes line. Anyway a central support post member is required in such an apparatus; this post member is equipped, according to the invention, with an additional clothes line which may be extended and put into operation quickly and easily, if required.

What I claim is:

1. A clothes drying apparatus comprising:

a central, elongate supporting post member;

a plurality of support arms for supporting a plurality of first clothes line portions extending between said support arms;

a collar member mounted on said supporting post member for supporting said support arms, said support arms having one end pivotally attached to said collar member, said collar member being axially displaceable along said supporting post member between upper and lower positions to move said support arms in a path between an extended position in which said support arms are spread out so that the first clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms;

a second clothes line portion extendable outside of said path of movement of said support arms and between said head member and an anchoring member distantly located from said supporting post member when said support arms are in the rest position;

storage means supported on said supporting post member for storing said second clothes line portion adjacent said supporting post member, said second clothes line portion having a first position in which it is wound onto said storage means outside of said path of movement of said support arms, and a second position in which it extends between said head member and an anchoring member;

means connected with said storage means for automatically rewinding said second clothes line portion onto said storage means when said second clothes line portion is disconnected from the anchoring member, said automatically rewinding means comprising means supported by said post for biasing said second clothes line portion to its first position in which the second clothes line portion is wound onto said storage means; and means for locking a section of said second clothes line portion in the vicinity of said head member in a retracted position of said second clothes line portion and for tensioning said second clothes line portion when in an extended position between said head member and the anchoring member, said locking and tensioning means comprising an extension member mounted on the upper surface of said head member, said head member being rotatably mounted on the top of said supporting post member to tension the second clothes line portion when the second clothes line portion is in said second position thereof.

* * * * *